US005887872A

United States Patent [19]

Keifer et al.

[11] Patent Number: 5,887,872

[45] Date of Patent: Mar. 30, 1999

[54] MEMORY GAME HAVING SEQUENTIALLY OPENED CAPSULES

[75] Inventors: James Keifer, Malibu; Alan Cusolito, Aliso Viejo, both of Calif.

[73] Assignee: Mattel, Inc., El Segundo, Calif.

[21] Appl. No.: 914,478

[22] Filed: Aug. 19, 1997

[51] Int. Cl.[6] ..... A63F 9/00

[52] U.S. Cl. ..... 273/273; 273/280

[58] Field of Search ..... 273/273, 280, 273/140, 447

[56] References Cited

U.S. PATENT DOCUMENTS

| | | | |
|---|---|---|---|
| D. 270,458 | 9/1983 | Samuels . | |
| 3,163,426 | 12/1964 | Ruderian . | |
| 3,195,896 | 7/1965 | Markham . | |
| 4,109,914 | 8/1978 | Matsumoto . | |
| 4,214,750 | 7/1980 | Shimizu . | |
| 4,298,199 | 11/1981 | Bush et al. . | |
| 4,310,156 | 1/1982 | Kulesza | 273/447 |
| 4,524,967 | 6/1985 | Hanson | 273/273 |
| 4,603,860 | 8/1986 | Wey . | |
| 4,714,249 | 12/1987 | Barlow . | |
| 4,787,640 | 11/1988 | Barlow . | |
| 5,193,819 | 3/1993 | Chen . | |
| 5,316,309 | 5/1994 | Takeshi . | |

*Primary Examiner*—William M. Pierce
*Attorney, Agent, or Firm*—Roy A. Ekstrand

[57] ABSTRACT

A base supports a rotatable turntable having a plurality of capsule bases each having capsule recesses formed therein. A plurality of capsule lids are pivotally supported upon the turntable and overlie their respective capsule bases providing closure of the recesses. A plurality of stationary cams are supported beneath the turntable and communicate with a corresponding plurality of cam following flanges which operate the capsule lids. A motor drive rotates the turntable upon the base such that the cam following flanges of the lids are intermittently pivoted to open positions as they pass some of the cams.

4 Claims, 3 Drawing Sheets

MEMORY GAME HAVING SEQUENTIALLY OPENED CAPSULES

FIELD OF THE INVENTION

This invention relates generally to games and particularly to those which utilize a plurality of opening and closing capsules or the like.

BACKGROUND OF THE INVENTION

Games which utilize a base supporting a plurality of capsules which are periodically opened are well known and have proven to be extremely popular in the toy industry. As a result, capsule opening type games have been provided in a variety of designs and themes ranging from opening flowers with interacting "honey bees" to aquatic themes utilizing fishing activity as well as various target or projectile launching themes. For example, U.S. Pat. No. 4,603,860 issued to Wey sets forth a TOY OF HONEY GATHERING BEE having a turning plate in which flowers may be raised up to open or lowered to close as the plate turns. A magnetic honey gathering bee is suspended from a string and supports a magnet. A plurality of magnetic simulated elements are supported within each flower with the object being to successfully gather the magnetic elements from the flowers as they open.

U.S. Pat. No. 4,298,199 issued to Bush, et al. sets forth a GAME having a game piece suspended on a string simulating a bee which is dangled by a player over a simulated flower which opens and closes and which contains items to be withdrawn from the flower without entrapping the bee in the closing action of the flower.

U.S. Pat. No. 4,214,750 issued to Shimizu sets forth an OCTOPUS CATCHING GAME KIT having octopus-shaped bodies each including a built-in magnet which are set in a number of receptacles on a playing surface. Each octopus-shaped body rises out of its receptacle at a particular time interval and may be caught by players properly manipulating a magnetized catching pot suspended on a string from a fishing rod.

U.S. Pat. No. Des. 270,458 issued to Samuels sets forth a BALL GAME BOARD having a center base supporting a plurality of dolphins which in turn have opening mouths and which are the target of projectiles launched toward the center piece.

U.S. Pat. No. 5,193,819 issued to Chen sets forth a DOLL CATCHING TOY having a base supporting a rotating disk. The disk supports a plurality of openable shell-like capsules which periodically open as the disk is rotated. An article such as a doll is captivated within each of the capsules and is retrievable by a fishing pole and magnet manipulated by the player.

U.S. Pat. No. 5,316,309 issued to Takeshi sets forth a MEMORY MATCHING GAME WITH MECHANICALLY ACTIVATED ROTATING DISK including a base, a rotatable disk mounted on the base and a cover mounted on the base above the disk. A clutch mechanism is provided for rotating the disk and a braking mechanism is provided for stopping rotation of the disk in one of a plurality of predetermined positions.

U.S. Pat. No. 4,109,914 issued to Matsumoto sets forth a GAME STRUCTURE EMPLOYING A REVOLVING TARGET having a cruciform-shaped base supporting a rotating receptacle at its center. The lid of the receptacle is pivotally mounted and is periodically opened by a cam and cam follower structure as it moves.

U.S. Pat. No. 4,787,640 issued to Barlow and U.S. Pat. No. 4,714,249 also issued to Barlow set forth mechanically actuated turntable target games.

U.S. Pat. No. 3,163,426 issued to Ruderian and U.S. Pat. No. 3,195,896 issued to Markham set forth early examples of rotatable game apparatus.

While the foregoing described prior art devices have provided some improvement in the art and have in some instances enjoyed commercial success, there remains nonetheless a continuing need in the art for evermore new and innovative game apparatus using periodically or sequentially open capsules.

SUMMARY OF THE INVENTION

Accordingly, it is a general object of the present invention to provide an improved memory game. It is a more particular object of the present invention to provide an improved memory game which utilizes a novel visual effect and which maintains the player's interest and motivation.

In accordance with the present invention, there is provided a memory game comprising: a base supporting a stationary cam plate and a plurality of cams thereon, the cam plate defining a center opening; a rotatable pulley rotatably supported beneath the cam plate upon the base; motor means for rotating the pulley; a turntable housing supported and rotated by the pulley above the cam plate defining a plurality of capsule bases each having a recess therein and a pivot aperture; a plurality of capsule lids each pivotally secured to the turntable housing and each having a flange extending downwardly through one of the pivot apertures; and a plurality of game articles received within the recesses, the turntable housing rotating the capsule lids about the cams whereby certain cams pivot certain pivot flanges to briefly open their respective capsule lids.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
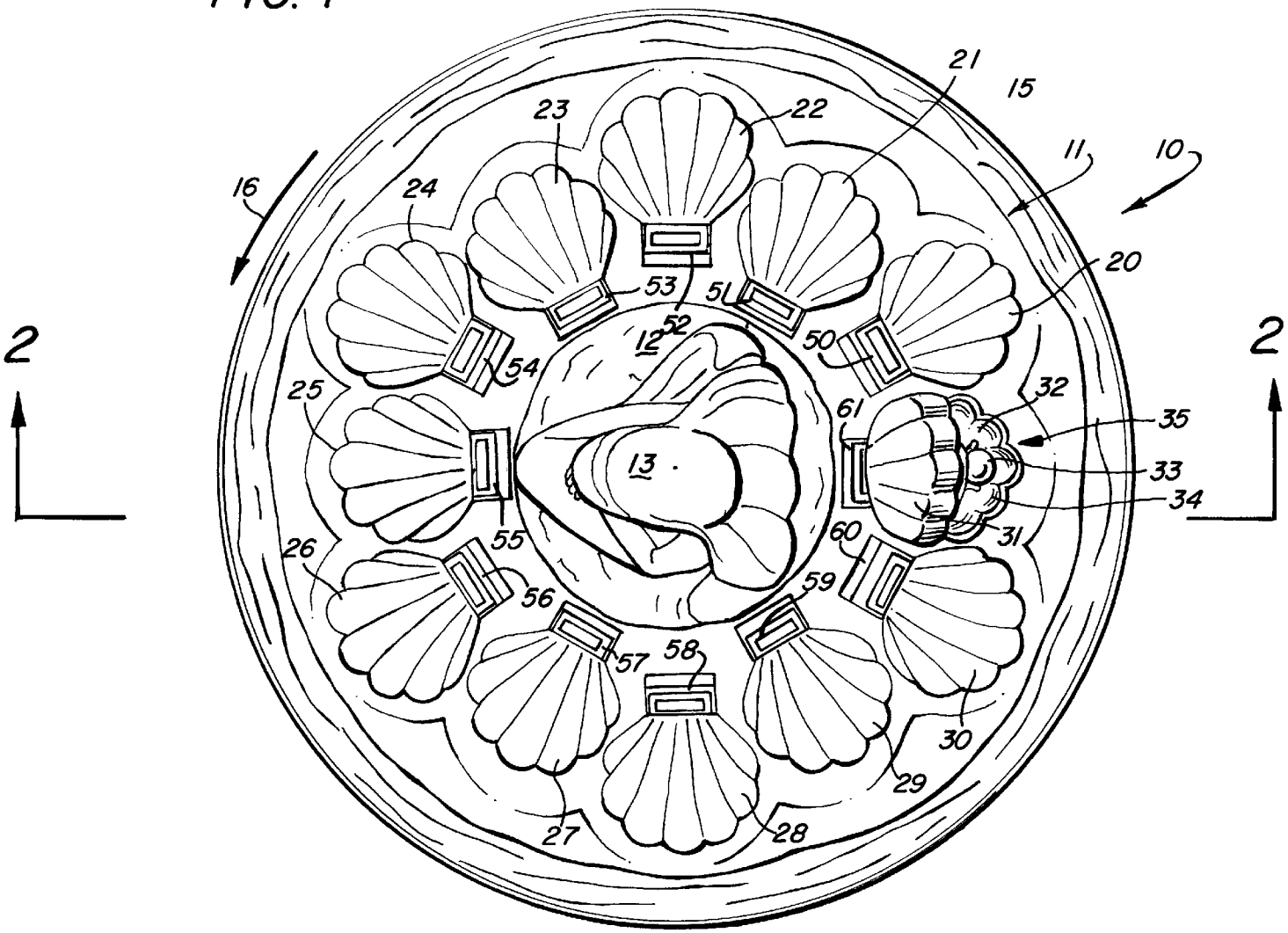
FIG. 1 sets forth a top view of a memory game constructed in accordance with the present invention.

FIG. 1 sets forth a top view of a memory game constructed in accordance with the present invention and generally referenced by numeral 10. Memory 10 includes a circular turntable base 15 which by means set forth below in greater detail is rotatably supported upon turntable base 15. By means set forth below in greater detail, turntable housing 11 is rotatably supported and rotates with respect to turntable base 15 in the direction indicated by arrow 16. Suffice it to note here that an internal battery-powered motor and drive mechanism is operative to rotate turntable housing 11 continuously. Game 10 further includes a plurality of capsule lids 20 through 31 arranged in an offset generally radial arrangement upon turntable housing 11. In the embodiment of the present invention shown in FIG. 1, capsule lids 20 through 31 are fabricated to resemble the upper portions of a seashell. It will be apparent to those skilled in the art, however, that other aesthetic themes may be utilized without departing from the spirit and scope of the present invention. Capsule lids 20 through 31 further include pivotal attachments 50 through 61 respectively which pivotally secure each capsule lid at a fixed position upon turntable housing 11. The fabrication of pivotal attachments 50 through 61 is set forth below in greater detail. However, suffice it to note here that each pivotal attachment facilitates the pivoting from the closed position shown for capsule lids 20 through 30 to the open position shown by capsule lid 31. By means also set forth below in greater detail, capsule lids 20 through 31 are intermittently opened for brief periods and then closed as turntable housing 11 rotates upon turntable base 15.

Figure 2:
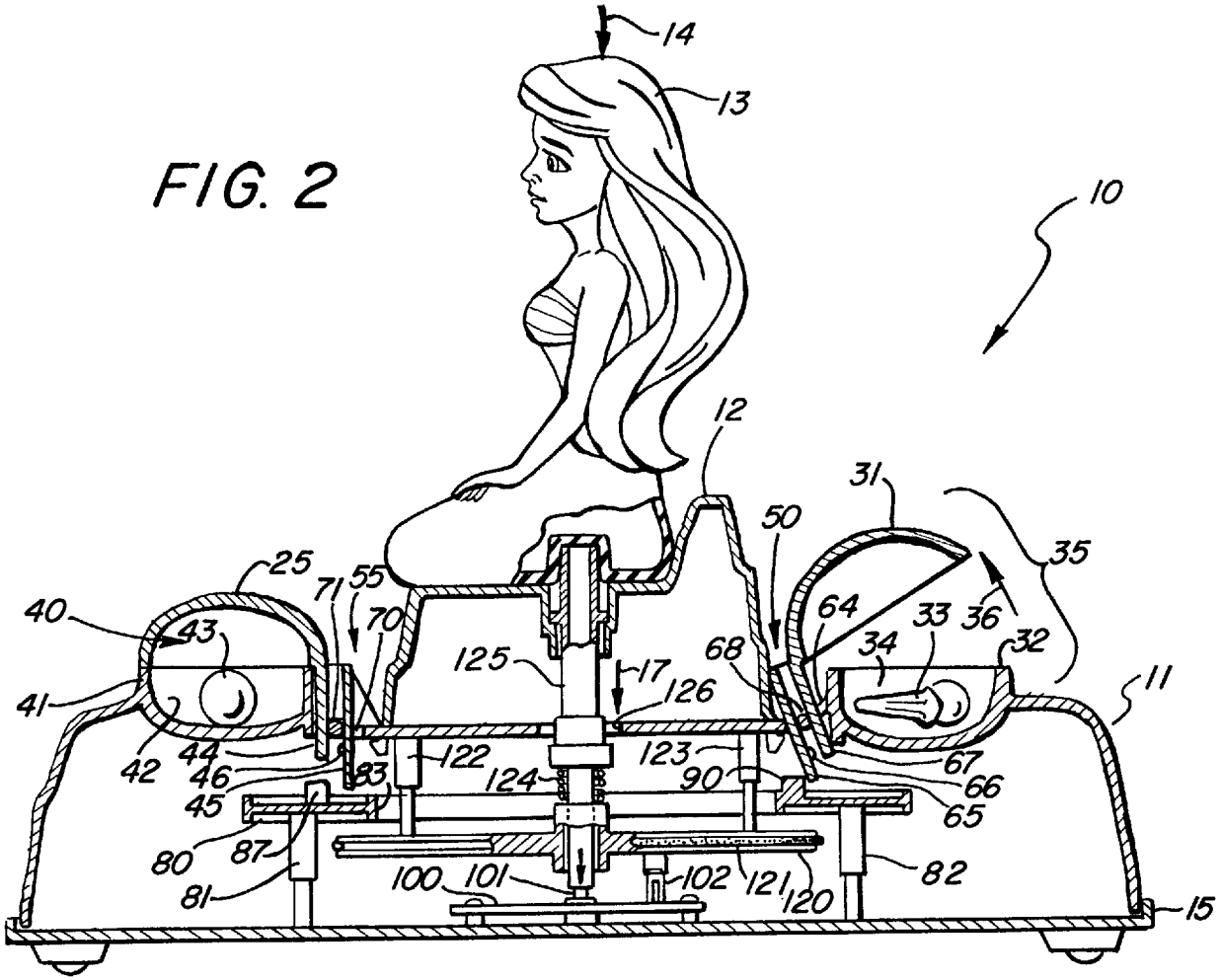
FIG. 2 sets forth a section view of the present invention memory game taken along section lines 2—2 in FIG. 1.

In further accordance with the present invention, turntable housing 11 defines a plurality of capsule bases such as capsule base 32 which form recesses (better seen in FIG. 2). In the general theme of seashells of the embodiment shown in FIG. 1, capsule base 32 is shaped to resemble the bottom half of a seashell. Accordingly, capsule base 32 defines a concave recess 34 having an outer shape which generally conforms to capsule lid 31. Thus, the combination of capsule lid 31 and capsule base 32 provides a capsule having an interior space entirely enclosed between capsule base 32 and capsule lid 31.

In further accordance with the present invention game, an article 33 is received within capsule base 32 and, except for the brief interval when lid 31 is opened, is entirely covered by capsule lid 31. In further accordance with the present invention, it will be understood that turntable housing 11 defines a plurality of capsule bases beneath capsule lids 20 through 30 which are identical to capsule base 32. Thus, each of capsule lids 20 through 30 also provides the upper portion of a capsule which may be opened in the same fashion as capsule lid 31. In further accordance with the structure of capsule base 32 and capsule lid 31 described, each of the enclosures formed beneath capsule lids 20 through 30 may receive a toy article such as article 33 shown within capsule base 32.

Turntable housing 11 further supports a center mound 12 formed to generally replicate a rock or stone which in turn supports a mermaid figure 13. Once again, it will be understood that the appearance of mound 12 and mermaid figure 13 are selected in accordance with aquatic theme of game 10. However, it will be apparent that other appearances for both mound 12 and figure 13 may be utilized without departing from the spirit and scope of the present invention.

In accordance with the present invention, game play is initiated by placing an article such as article 33 within each of the capsules formed beneath capsule lids 20 through 31. Thereafter, the players gather around game 10 and initiate its operation by pressing downwardly upon figure 13. By means set forth below in FIG. 2 in greater detail, the downward movement of figure 13 turns the activating switch for the rotating mechanism of game 10 to the on position and turntable housing 11 begins rotating in the direction indicated by arrow 16. As turntable housing 11 rotates with respect to turntable base 15, the cam driven mechanism of the present invention cooperates with pivotal attachments 50 through 61 to intermittently open each of the capsules upon turntable housing 11 by pivoting its respective capsule lid to the opened position shown in FIG. 1 for capsule lid 31. As each capsule lid periodically pivots open exposing the contents therein and thereafter closes, the players interact with the rotating turntable to pick a particular type of article from its capsule during the open time. The challenge arises in that only certain articles may be withdrawn by certain players. That is, each has their target family of articles such as articles of a common color or the like. The challenge is to remember where the target articles are located as the capsule lids remain closed for most of the time.

FIG. 2 sets forth a section view of game 10 taken along section lines 2—2 in FIG. 1. As described above, game 10 includes a base 15 rotatably supporting a turntable housing 11. As is also described above, turntable housing 11 supports a center mound 12 which in turn supports a figure 13. Toy 10 includes a plurality of capsules formed by pivotable lids and capsule bases. The latter are formed within turntable housing 11 and define respective recesses. For example, a capsule 35 is formed by pivotable lid 31 and capsule base 32. Base 32 defines a recess 34 within which an article 33 is received. A pivotal attachment 50 pivotally secures lid 31 to turntable housing 11. Attachment 50 includes an aperture 64 formed in turntable housing 11 behind capsule base 32. A crossbar 68 extends through aperture 64. Pivotal attachment 50 further includes a pair of spaced apart flanges 65 and 67 extending downwardly from lid 31 on either side of crossbar 68. A rib 66 extends transversely across flange 65 beneath crossbar 68.

A similar capsule 40 is formed by capsule lid 25 and base 41. Base 41 defines a recess 42 within which an article 43 is received. A pivotal attachment 55 is operative upon capsule lid 25 and includes an aperture 70 formed in turntable 11 having a crossbar 71 extending therethrough. Pivotal attachment 55 further includes a pair of spaced apart flanges 44 and 45 extending downwardly from the rear portion of capsule lid 25. Flange 45 supports a rib 46 which extends beneath crossbar 11. As a result, capsule lid 25 is pivotally secured to turntable 11 in the same manner as described for capsule lid 31. With temporary reference to FIG. 1, it will be understood that a plurality of capsules are formed beneath capsule lids 20 through 30 which are substantially identical to capsules 35 and 40 shown in FIG. 2.

In further accordance with the present invention, a cam platform 80 is supported above base 15 by a plurality of posts such as posts 81 and 82. Of particular importance with respect to the present invention is the positioning of a plurality of stationary cams such as cams 87 and 90 shown in FIG. 2. Platform 80 further defines an opening 83.

A printed contact board 100 having a plurality of conductive metal contacts printed thereon (not shown) is supported upon base 15 and a bearing 101 is positioned at the center of contact board 100. A pulley 120 having a belt 121 engaged thereto is rotatably supported by bearing 101. A plurality of upwardly extending posts 122 and 123 extend upwardly from pulley 120 and together with additional posts shown in FIG. 3 support turntable housing 11 in a rotatable support upon bearing 101.

Turntable housing 11 further defines an aperture 126 through which a rod 125 extends. Rod 125 is coupled to and supported by pulley 120. A spring 124 urges rod 125 upwardly. A contact 102 is supported on the underside of pulley 120 and is positioned above contact board 100.

In operation, the user initiates the motor driven rotation of turntable housing 11 by pushing figure 13 downwardly as indicated by arrow 14. The downward force upon figure 13 is communicated to rod 125 which is pushed downwardly in the direction indicated by arrow 17 overcoming the force of spring 125 and forcing contact 102 downwardly upon connection board 100. This establishes electrical connection for the motor drive circuit (seen in FIG. 3) causing the motor drive circuit to begin rotating pulley 120 and turntable housing 11 in the manner described in FIG. 3 in greater detail.

As turntable housing 11 and pulley 120 are rotated, the plurality of capsules such as capsules 35 and 40 shown in FIG. 2 are rotatably moved with respect to stationary cams 87 and 90 supported upon cam platform 80.

A capsule is opened in the manner shown in FIG. 2 by capsule 35 when it moves past a cam such as cam 90 which is placed upon cap platform 80 so as to contact and pivot its interior flange (in this case flange 65). The action of cam 90 against flange 65 pivots lid 31 about crossbar 68 as indicated by arrow 36 opening capsule 35. Once capsule 35 is moved due to continued rotation of turntable housing 11 beyond cam 90 the gravitational force acting upon lid 31 again closes capsule 35.

For further illustration, capsule 40 is shown in the closed position and is moving past cam 87 upon cam platform 80 which is not within the travel path of flange 45. As a result, capsule 40 will not open as cam 87 is passed by capsule 40 during the rotation of turntable housing 11.

Thus, as turntable housing 11 rotates the plurality of capsules supported thereon past the plurality of cams (cams 85 through 90 shown in FIG. 3), the various capsules are periodically opened for a short time as their lids pivot upwardly and then close to remain closed hiding the contents of the capsule. The challenge for the player is to remember which capsule held the article of interest to the player.

Figure 3:
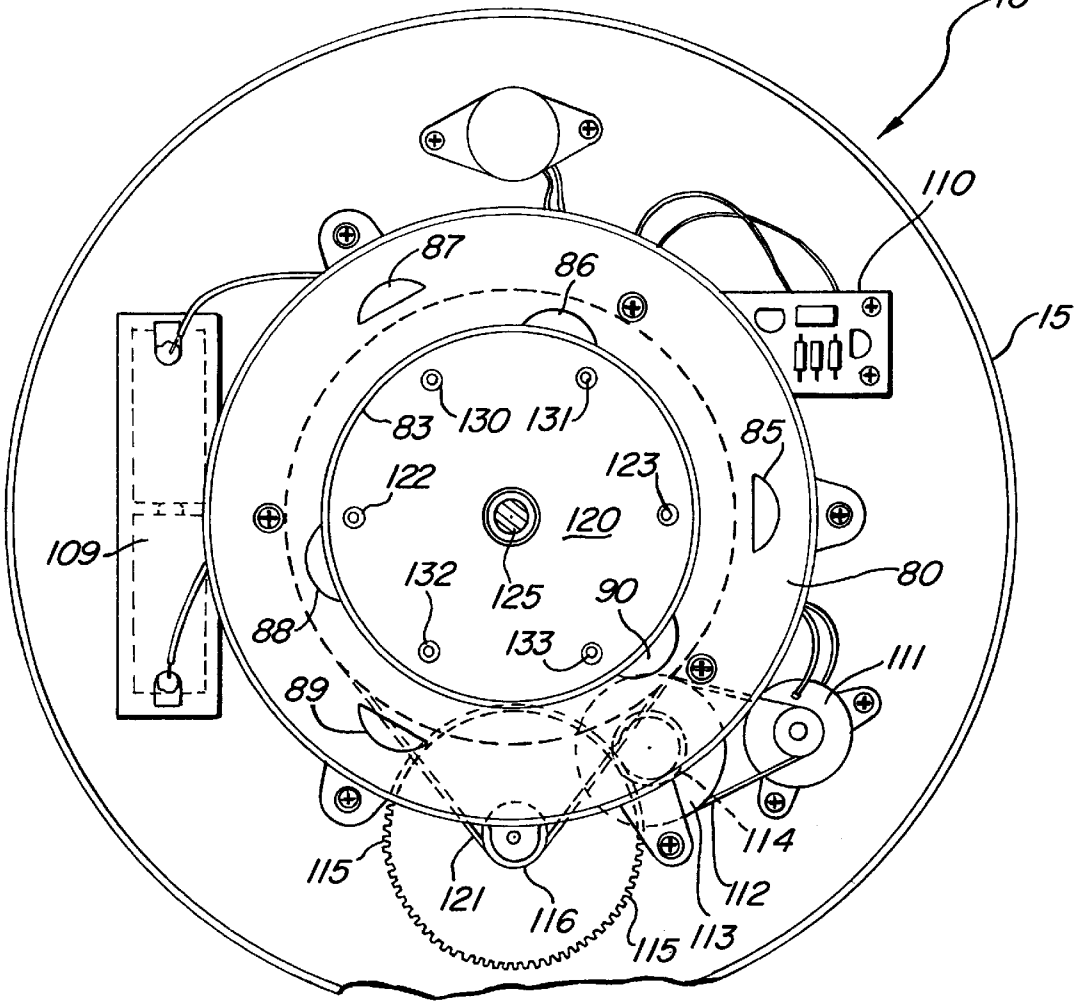
FIG. 3 sets forth a top view of the present invention memory having the upper turntable housing removed to show the internal turntable apparatus.

FIG. 3 sets forth a top view of game 10 having turntable housing 11 and mound 12 together with figure 13 removed therefrom. As described above, base 15 supports a stationary cam platform 80 having a plurality of cams 85 through 90 positioned at various locations about the upper surface of cam platform 80. As is also described above, a rotatable pulley 120 and shaft 125 are rotatably supported beneath cam platform 80. As is also described above, cam platform 80 defines a center opening 83. Within the interior of opening 83, pulley 120 supports a plurality of upwardly extending posts 122, 123 and 130 through 133. Posts 122, 123 and 130 through 133 support turntable housing 11 in the manner seen in FIG. 2 and described above.

Toy 10 further includes an electronic control circuit module 110 powered by a battery power source 109. Also supported within toy 10 upon base 15 is a motor 111 operatively controlled by module 110. Motor 111 is coupled to a pulley 113 by a belt 112. Pulley 113 supports a gear 114 which is further coupled to a gear 115. Gear 115 in turn supports a pulley 116 which is coupled by a belt 121 to pulley 120.

In operation, when the switch formed by contact 102 and contact board 100 (seen in FIG. 2) is actuated by the user, circuit module 110 activates motor 111. The rotational power of motor 111 is coupled through belt 112, pulley 113, gear 114, gear 115, pulley 116 and belt 121 to rotate pulley 120.

As mentioned above, turntable housing 11 and the plurality of capsules formed thereon (seen in FIGS. 1 and 2) is rotated and supported by pulley 120.

Thus as pulley 120 rotates, turntable housing 11 (seen in FIG. 2) rotates with respect to stationary cams 85 through 90 on cam platform 80. As a result, the various cams are brought into contact with capsules at different positions about the turntable causing brief opening of the capsules for the above-described game play.

What has been shown is an improved memory game which utilizes an amusing array of rotating capsules to briefly expose articles which must then be remembered as to location and type by the players.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A memory game comprising:

a base supporting a stationary cam platform, said cam platform having a plurality of cams formed thereon and a center opening formed therein, said plurality of cams positioned upon said cam platform in an offset generally radial arrangement;

a rotatable pulley rotatably supported beneath said cam platform upon said base;

motor means for rotating said pulley;

a turntable housing supported and rotated by said pulley above said cam platform defining a plurality of capsule bases arranged in an offset generally radial arrangement upon said turntable housing corresponding to said cams each having a recess therein and a pivot aperture;

a plurality of capsule lids arranged in an offset generally radial arrangement corresponding to the offset generally radial arrangement of said cams each pivotally secured to said turntable housing in alignment with one of said capsule bases and each having a flange extending downwardly through one of said pivot apertures; and a plurality of game articles one of which is received within each of said recesses, said turntable housing rotating said capsule bases and said capsule lids about said cams whereby each of said cams contacts and pivots some of said pivot flanges and misses others such that certain cams pivot certain pivot flanges to briefly open their respective capsule lids.

2. The memory game set forth in claim 1 wherein said capsule lids resemble seashells.

3. The memory game set forth in claim 2 further including a figure supported at the center of said turntable housing.

4. The memory game set forth in claim 3 wherein said base includes a center bearing supporting said pulley.

* * * * *